United States Patent [19]

Greenbaum

[11] Patent Number: 5,022,555

[45] Date of Patent: Jun. 11, 1991

[54] COMPLY SYSTEM

[76] Inventor: George Greenbaum, 1005 N. Caribe Ave., Tucson, Ariz. 85710

[21] Appl. No.: 559,311

[22] Filed: Jul. 30, 1990

Related U.S. Application Data

[63] Continuation-in-part of Ser. No. 403,674, Sep. 6, 1989.

[51] Int. Cl.[5] ..... B65D 90/04

[52] U.S. Cl. ..... 220/401; 220/461; 220/651; 220/668

[58] Field of Search ..... 220/565, 9.1, 9.3, 401, 220/461, 651, 668

[56] References Cited

U.S. PATENT DOCUMENTS

| | | | |
|---|---|---|---|
| 1,477,686 | 12/1923 | Braender | 220/9.1 |
| 2,361,743 | 10/1944 | Butler | 220/9.3 |
| 2,437,058 | 3/1948 | Waters | 220/1 B |
| 2,507,939 | 5/1950 | Smith | 220/1 B |
| 3,105,617 | 10/1963 | Felldin | 220/84 |
| 4,875,596 | 10/1989 | Lohse | 220/403 |

*Primary Examiner*—Joseph Man-Fu Moy

*Attorney, Agent, or Firm*—Samuels, Gauthier & Stevens

[57] ABSTRACT

A container for liquid comprises a liner having longitudinal members compressively secured together by a first carrier film. One water impermeable barrier film overlies the liner. A second carrier film overlies the barrier film to form a shell. Reinforcing members secure to the shell. A third carrier film secures the members to the shell to form the container. Valve introduces the liquid into the container and remove the liquid from the container.

15 Claims, 3 Drawing Sheets

COMPLY SYSTEM

CROSS REFERENCE TO RELATED APPLICATIONS

This application is a continuation-in-part application of U.S. Ser. No. 403,674 filed Sept. 6, 1989.

BACKGROUND AND SUMMARY OF THE INVENTION

The present invention relates to a low cost system for the fabrication of storage containers and the containers so formed.

Storage containers or vessels are usually fabricated from cast materials whether metal or plastic or they may be flexible containers with or without reinforcing. The following prior art is believed relevant to the present disclosure. U.S. Pat. Nos. 3,657,042; 4,277,688; 3,875,723; 4,353,763; 4,132,050; 4,409,776; 2,260,064; and 4,451,739; and European Patent 0072429.

There is a need for a vessel, container, tank or related structure that has low cost, ease of on site fabrication and particularly, a highly sophisticated custom tailored construction to match demanding specifications.

Broadly, the invention is directed to a container comprising a liner. The liner is light-weight frame secured together with a tough, resilient skin. Ideally, the container is fabricated on site.

The frame is a skeletal structure. A plurality of standard pipes and fittings are joined together to define the frame. Preferably, no adhesives are used. Further, threaded joints or matched tolerances for compressive fits between pipes and fittings is not required.

The liner is made by winding around the frame under tension selected plastic 'carrier' films, such as the films known as stretch wrap films. The carrier film compressively secures the pipes and fittings together. Overlying the carrier film is a 'barrier' films which is distinct chemically and/or physically from the carrier film. When carrier film is applied under tension, there is always the possibility that pin holes will develop. Therefore, a barrier film, which is impervious to water, is used. Carrier film is wound over the barrier film to form a shell.

The wall(s) and/or bottom of the shell are strengthened with reinforcing members which are secured against the shell walls with carrier film. The carrier film compressively secures the members to the shell to form the container. Preferably, the members are secured one to the other. In that the reinforcing members do not come in contact with the stored water, adhesives may be used to secure them to one another. However, as with the frame, for simplicity, it is preferred simply to assemble the reinforcing members against the shell walls and overwrap the reinforcing members to compressively secure them one to the other and to the shell.

Although there are many potential uses for the invention, in the preferred embodiment, the system is used for collecting and storing water. The upper surface of the container is covered with a pattern of selected openings which permits the flow of liquid therein regardless of origin, rainfall, storm flow, melting snow, etc. Withdrawal of water is accomplished by means of simple valves and piping.

DESCRIPTION OF THE PREFERRED EMBODIMENT(S)

The basic container comprises a liner, a barrier film overlying the liner and a carrier film to secure the liner in place. The liner comprises a frame and carrier film. Reinforcing members are secured to the shell and overwrapped with carrier film to form the container.

When the frame is assembled, continuous longitudinal plastic pipes, such as pvc pipes, are joined one to the other with standard fittings. To enhance the strength of the structure, cement may be poured into the open pipe. This would include a cement mixture with granules to give it greater resiliency or a precatalyzed polymerizable liquid base material which hardens into a tough solid mass.

Figure 1:
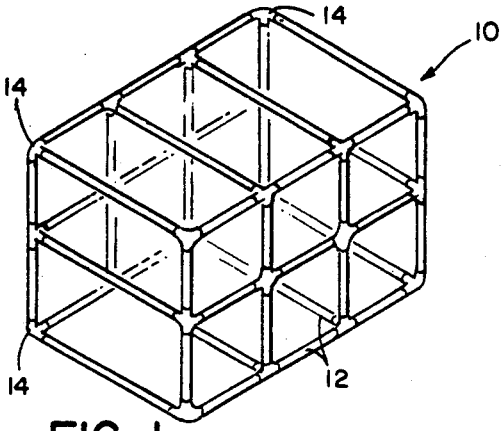
FIG. 1 is a perspective view of a frame.

Referring to FIG. 1, a generally rectangular frame 10 is shown and comprises pipes 12, such as PVC pipes, joined together with standard fittings 14 such as Ts, corner fittings, four-way fittings, etc. where necessary.

The pipes and fittings are loosely assembled and no adhesives are used and threads and compression fits are not required.

Figure 2:
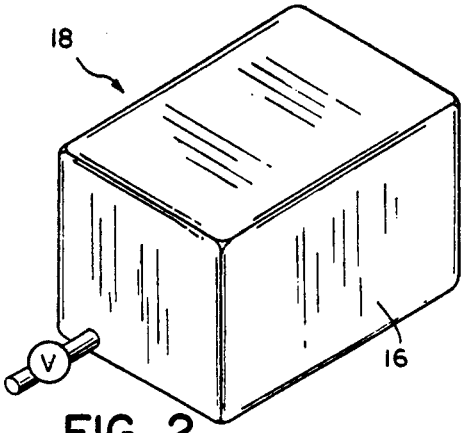
FIG. 2 is a perspective view of the frame of FIG. 1 with a first wrapping of carrier film to form a liner.

Referring to FIG. 2, the frame is wrapped (first wrapping) with carrier film material 16 to form a liner 18. The frame is wrapped with four or more plies of stretch wrap under tension. The carrier film compresses the frame to form a very tight structure. The pressure the film creates, wound under tension, forces all the elements of the frame (pipe and fittings) to be literally squeezed together in a strong and sturdy configuration. Thus, the frame can be assembled with the fittings but without the necessity of using adhesives which are generally toxic.

Figure 3:
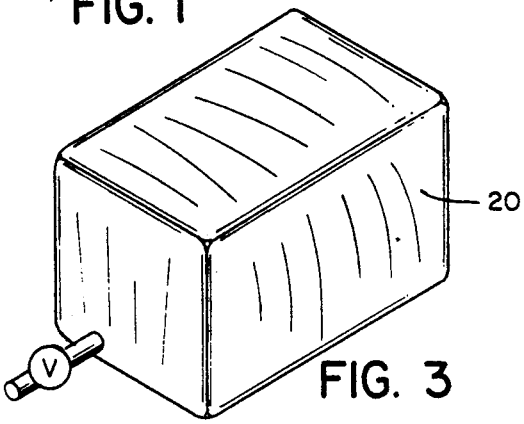
FIG. 3 is a perspective view of FIG. 2 with a wrapping of impervious barrier film.

Referring to FIG. 3, a barrier film 20 is then wrapped about the liner 18. This barrier film 20 is preferably a laminated polyolefin or polyvinyl and initially is held in place by the use of any suitable cement or the like. This barrier film ensures that if there are leaks in the stretch wrap that the water will not leak from the finally assembled container. Preferably, the barrier film is 2 to 4 mil polyethylene and/or PVC film of at least two layers laminated to itself, such as by adhesives.

Figure 4:
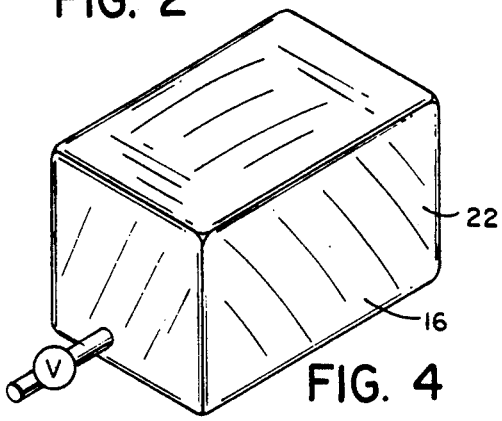
FIG. 4 is a perspective view of FIG. 3 with an additional wrapping of carrier film to secure the barrier film and to form a shell.

Referring to FIG. 4, a second wrapping of carrier film 16 is applied over the barrier film to form a shell 22. If desired, this second wrapping of carrier film can comprise a mesh-like film which is then coated with cement or similar material to provide increased rigidity to the final structure.

Figure 5:
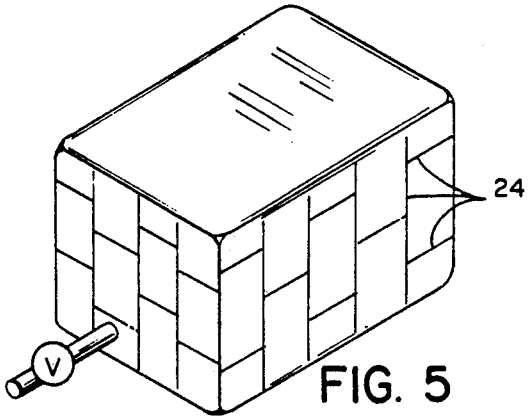
FIG. 5 is a perspective view of the shell of FIG. 4 with additional reinforcing members.

Typically, if the shell 22 were filled with water, it would tend to bulge because of the pressure. Referring to FIG. 5, the shell 22 of FIG. 4 has reinforcing members 24, PVC pipes and fittings, secured against the outer surface of the shell.

Figure 6:
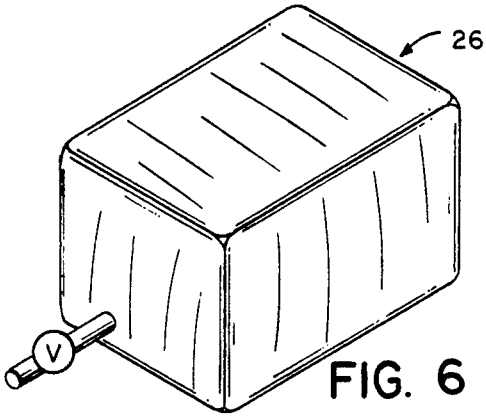
FIG. 6 is a perspective view of FIG. 5 with carrier film securing the additional members to form a container.
Figure 7:
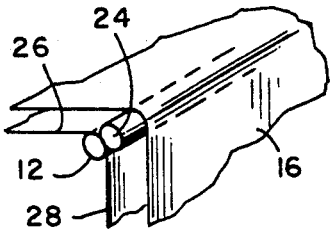
FIG. 7 is a sectional perspective view of the container of FIG. 6.

Referring to FIG. 6, additional carrier film 16 is wrapped around the reinforcing members 22 to compressively secure them against the shell wall to form a container 26. This combination of reinforcing members and additional film 16 also functions to insulate the water stored in the container. Referring to FIG. 7, the insulating layer 28 is shown between the shell 22 and additional film 16. Further, this last wrapping is subject to degredation and abuse and can be easily removed and replaced.

Figure 8:
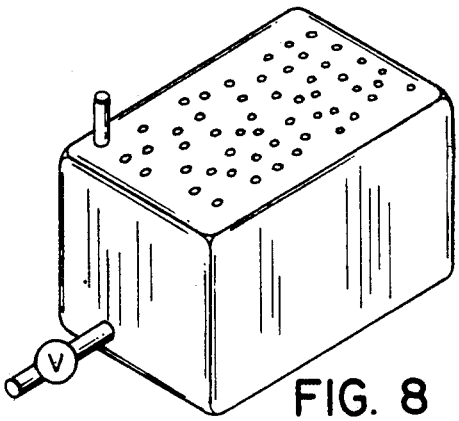
FIG. 8 is a perspective view of FIG. 6 illustrating a top filter.

As shown in FIG. 8, after the container 26 is finally assembled, the top of the container may be perforated with an array of small holes to function as a filter(s) to allow water and the like to flow into the container. Alternatively, fittings 32 are shown to which can be secured to valves or other pipes. The manner of securing these fittings is well within the skill of the art.

Figure 9:
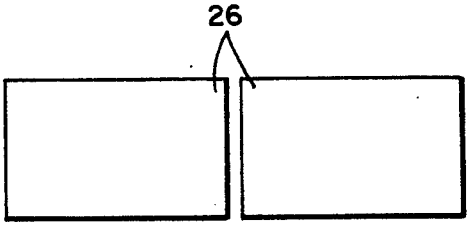
FIG. 9 is a front view of two containers used as modules.

Although the container has been disclosed as a single unit, it is within the scope of the invention that the container can function as a module and be joined to like containers with suitable fittings to allow for the flow of water between the containers when they function as modules. Referring to FIG. 9, two containers 26 are joined end to end and wrapped with carrier film having the necessary adhesive characteristics, including having adhesive coatings thereon to join the containers one to the other.

Figure 10:
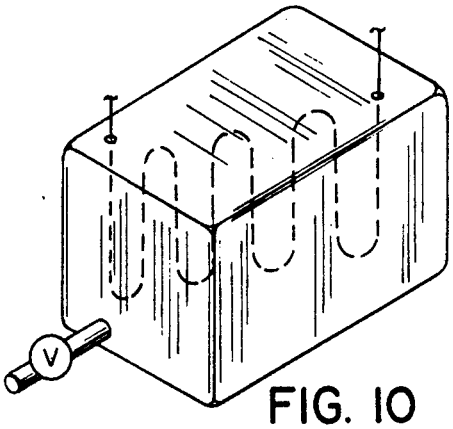
FIG. 10 is a schematic illustrating a disinfection device.

To aid in the disinfection of the water, referring to FIG. 10, a coil 34 of copper or silver is placed in the tank and has an electromotive force applied thereto. This will aid in the disinfection of the water.

Figure 11:
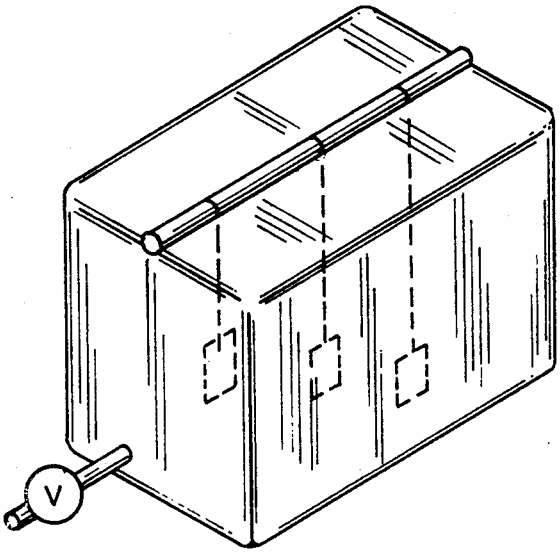
FIG. 11 is a perspective view of FIG. 7 having time release anti-microbial substances therein.

Referring to FIG. 11, an alternative or additional technique to aid in the disinfection of water is to suspend time-release pourous-walled packages or perforated cylinders of anti-microbial materials 36 in the water at various depths, as shown, to ensure that the water will remain pure at the different levels. The packages, such as activated charcoal or chlorine-emitting types or other bactericidal compounds known to be effective in disinfecting water, are suspended from a rod 38 by lines 40. Additionally, other additives, such as sodium or stannous chloride, may be added for tooth protection. Further, treated or untreated bentonite clay with silver compounds, such as colloidal silver or silver salts, can be used. Lastly, solids that generate oxygen when immersed in water, such as sodium perborate and similar compounds, can be used.

Figure 12:
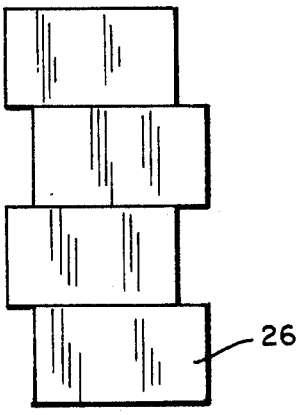
FIG. 12 is a purification system using the comply storage containers of the invention.

FIG. 12 is a schematic view of stacked containers, the upper three functioning in combination as a purification section followed by a disinfection section. Specifically, the upper three containers which are in fluid flow communication with one another function as follows from the uppermost container; a first flocculation zone, the next lower succeeding container functioning as a sedimentation zone, the next lower succeeding container functioning as a purification/filtration zone and may contain sand/gravel to function as a filtering medium, and the bottom container functioning as a storage container in accordance with the invention and including the disinfecting features. Obviously the three containers solely for purification may be used alone or in combination with a container for disinfection.

Storage containers of the invention may also be used in a sanitation scheme wherein they can function as privies. Preferably, more than one would be used, say for example three, such that when one is in use, waste in the other two would be in various stages of anaerobic digestion where biogas, such as methane, useful for cooking, is generated and ultimately the waste could be used as fertilizer. Typically, a first container would be in use and after a period of time, a second container used and after a period of time, a third container used wherein the waste in the first container would be substantially anaerobically digested.

The actual technique of wrapping is not a part of the invention. Any wrapping techniques including spiral wrapping techniques known to those skilled in the art for wrapping rectangular, semi-circular, circular containers and the like with a plurality of films, webs, ribbons and the like may be used. One of the factors considered in selecting the films of the container disclosed herein, and particularly for the liner film, is to use resins which will not effect the taste of the stored water.

In wrapping the frame 10, a film, such as 2 mil high molecular weight crosslinked polyethylene or 1½ mil high density, high molecular weight polyethylene film, is wrapped about the structure 10. When it is desired to interleave a barrier film, it is wrapped around the carrier film 10. The width of the barrier film is generally co-extensive with the lateral edges of the carrier film and long enough such that it completes one and one half revolutions about the structure 10.

Depending upon the size of the container, the number of layers of barrier film will vary. For example, it may be feasible to make 20 wraps or revolutions of carrier film, followed by two or three or more revolutions of barrier film followed by 10 or 20 wraps of carrier film which again may be followed by wraps of the same or distinct barrier films followed by a final wrap or wraps of carrier film.

When the frame 10 is wrapped to the desired degree, the carrier film is severed and the trailing edge of the carrier film is fused or adhered, such as with epoxy adhesives, to form a wall seal.

Figure 13:
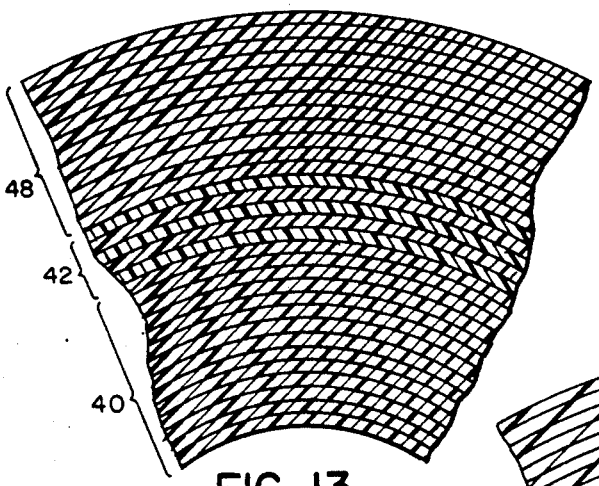
FIGS. 13–15 are sectional views of different carrier film/barrier film combinations.
Figure 14:
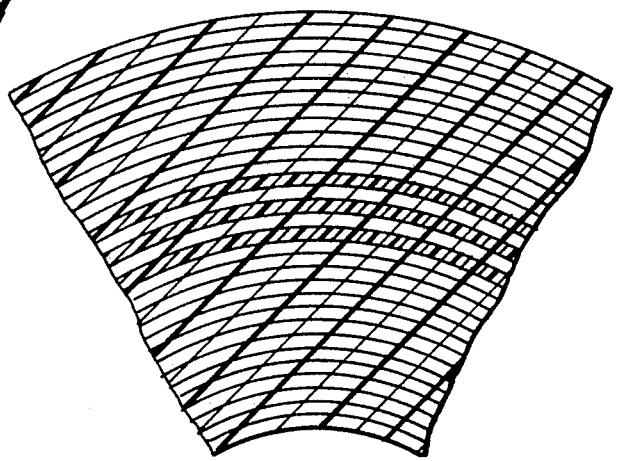
Figure 15:
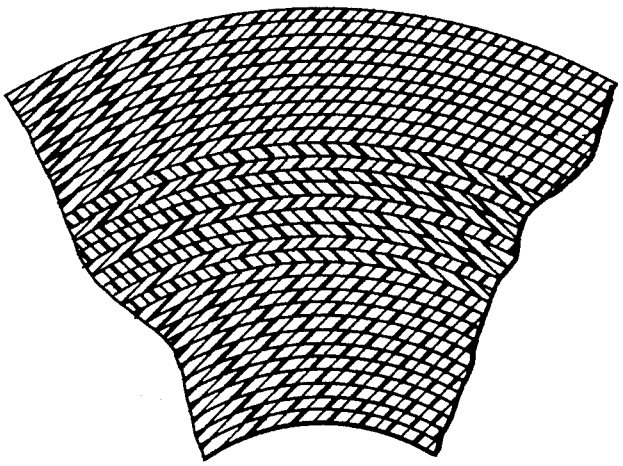

FIGS. 13 through 15 are sectional views of various combinations of container walls. In FIG. 13, there are twenty (20) inner layers of carrier film 40 followed by three revolutions of barrier film 42 followed by twenty layers of carrier film 40. The outer surface is heat sealed, i.e., the first two or three outer layers are bonded or they can be adhered by adhesives.

In FIG. 15, fifteen inner layers of carrier film are followed by five revolutions of barrier film, and the sheets of barrier film are disposed on both sides of each carrier layer through the five revolutions such that there are five contiguous revolutions of barrier film. The barrier film is followed by two layers of carrier film. Any combination of the foregoing may be used. The bonding of the layers may be, to any degree, from simply sealing the trailing edge of last layer to bonding all layers.

Preferably, stretch film is wound around the outside surface of the frame with a variable number of layers which will be determined by the ultimate size of the container. The larger vessel is, the more material it will hold and therefore greater wall strength will be required. That is, the greater the weight, the greater will be the thickness of the film wall. The stretch films slightly tacky surface will make a soft, strong and resilient barrier. Thus, the wrapping may be left intact as such and become the finished container.

In the preferred embodiment, then, there are three overwrappings of carrier film; a first wrapping to form the liner; a second wrapping to secure the barrier film in place; and a third wrapping to secure the reinforcing members in place. For the first wrapping and/or barrier film, the films are preferably treated or have incorporated therein a leachable anti-microbial agent to disinfect the stored water. When the second and third plies of carrier film are being applied, except for the liner, a high tack adhesive or polymerizable epoxy may be sprayed to enhance bonding. For the second and third wrappings, barrier films may be used to enhance the properties of the container.

Preferred barrier films include but are not limited to polycarbonates, polyvinyl, alcohols, polybutylenes, polyvinylidenes chlorides, polyvinylchlorides, polystyrenes, halogenated fluoropolyethylenes (Tedlar of du Pont), resin and polymer saturated papers.

The barrier film preferably has a melt index which is compatible with the carrier film. If the layers of carrier film adjacent the barrier film are fused, then the barrier film should be selected to adhere to the carrier film without losing its chemical and physical properties. Such combinations are readily determinable by one skilled in the art.

Adhesives, high or low viscosity, may be used per se as a barrier film. The adhesives may have incorporated therein pesticides to prevent contamination of the contents of the container. Abrasive material, such as sand, glass frit or fiberglass, may be used with the adhesive layer and/or with the pesticides to prevent or discourage pests including mice and rodents from penetrating the container.

The adhesives, when used, may range from minimal ones that simply act as "tackifiers" to hold in place several inner layers to high tack adhesives and/or very viscous adhesives to prevent dislodgement of adhered layers. Gas impermeable membranes may be made of laminated films; nylon fabrics that impart great resistance to punture/penetration; radiation reflecting surfaces such as metallized films all may be used either alone or in combination.

In addition, should particularly strong chemical resistance be needed for protection from the outside, spraying or coating so-called prepolymers (polymers that have not yet been fully polymerized), which in presence of ultra-violet or other exposure, are transformed in situ among the layers into a super tough, ultra-strong and chemically resilient barrier.

The number of stretch film layers in this applications can be varied to withstand any resulting internal pressure.

The carrier film is fusible at low temperatures or by the application of adhesives. Only the outer layers may be fused or adhered or all layers may be fused into one integral piece.

The preferred embodiment has been described wherein the carrier film is high density, high molecular weight polyethylene. An equally preferred embodiment is where the carrier film is polyethylene or PVC stretch wrap.

This carrier film is cohesive and at ordinary room temperatures and under tension allows two adjacent film surfaces to cling/adhere together to form an integral piece.

The stretch wrap does not cling/adhere as does the low density polyethylene. When a sleeve is formed the trailing edge of the stretch wrap is adhered to the next inner layer by the application of heat or adhesives. The application of heat enhances the adhesive characteristics of the film, but the film does not fuse and become a single mass. Then ends of the sleeve are formed are sealed by tying the same. They cannot be fused at low temperatures. The preferred method of tying is the 'tipper tie' which is placing a metal band about the ends and crimping the same. This tie is used in the meat packing and will hold a vacuum. Thus, tying the ends with this technique will encapsulate the wastes in a fluid impermeable container.

Having described my invention, what I now claim is:

1. A container which comprises:

a liner having longitudinal members compressively secured together by a first carrier film;

at least one water-permeable barrier film overlying the liner;

a second carrier film overlying the barrier film to form a shell;

reinforcing members secured to the shell;

a third carrier film to secure the members to the shell to form the container;

means to introduce a liquid into the container; and means to remove the liquid from the container.

2. The container of claim 1 wherein means to introduce liquid into the container and comprises a filter.

3. The apparatus of claim 2 wherein the container is substantially rectangular in shape.

4. The container of claim 1 wherein the barrier film has a melt index which is compatible with the melt index of the carrier film and the barrier film adjacent to the carrier film adheres to the carrier film without loosing its physical and chemical properties.

5. The container of claim 4 wherein the barrier film comprises an adhesive layer.

6. The container of claim 1 wherein the barrier film comprises at least two distinct laminated films.

7. The container of claim 1 wherein the carrier film is low density polyethylene.

8. The container of claim 1 wherein the carrier film is polyethylene or polyvinyl chloride stretch wrap.

9. The container of claim 1 wherein the barrier film is selected from the group consisting of polycarbonates, polyvinyl alcohol, polybutylene, polyvinyl chlorides, polyvinylidene chlorides, polystyrene and halogenated flouro polyethylenes and metallic foils, resin and polymer saturated papers, heat resistant materials and combinations thereof.

10. The container of claim 1 wherein the barrier film comprises an interlayer formed of polymerizable resins and polymers.

11. The container of claim 1 wherein the longitudinal members are tubular pipes and fittings.

12. The container of claims 1 and 10 which includes: means to disinfect the water disposed therein.

13. The container of claims 1 and 10 wherein the third carrier film defines with the shell an insulating layer therebetween.

14. The container of claim 1 which includes:

a plurality of containers in fluid flow communication with one another, the containers functioning in combination as a purification system, the first said container functioning as a flocculation chamber, a second succeeding container functioning as a sedimentation chamber, and a third succeeding container functioning as a purification/filtration chamber.

15. The container of claim 1 which includes:

a plurality of containers functioning as a sanitary system wherein at least one container is in use for waste deposit while the waste deposit in another container is being anaerobically digested.

* * * * *